US008511671B2

(12) United States Patent
Takiguchi et al.

(10) Patent No.: US 8,511,671 B2
(45) Date of Patent: Aug. 20, 2013

(54) SHEET FEEDING APPARATUS AND IMAGE FORMING APPARATUS

(75) Inventors: Masatoshi Takiguchi, Susono (JP); Shinya Noda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/159,825

(22) Filed: Jun. 14, 2011

(65) Prior Publication Data

US 2011/0316222 A1 Dec. 29, 2011

(30) Foreign Application Priority Data

Jun. 28, 2010 (JP) ..... 2010-146195

(51) Int. Cl.
*B65H 3/06* (2006.01)

(52) U.S. Cl.
USPC ..... 271/114; 271/167; 271/127

(58) Field of Classification Search
USPC ..... 271/109, 113, 114, 116, 126, 127
See application file for complete search history.

(56) References Cited

U.S. PATENT DOCUMENTS 5,253,854 A 10/1993 Tanoue et al.
6,070,867 A * 6/2000 Tsurumi et al. ..... 271/114
6,719,284 B2 * 4/2004 Hsiao et al. ..... 271/116
7,594,650 B2 * 9/2009 Chung et al. ..... 271/116
8,342,509 B2 * 1/2013 Takiguchi et al. ..... 271/119
2011/0156336 A1 6/2011 Agata et al.

FOREIGN PATENT DOCUMENTS

EP 0504833 A1 9/1992
EP 0504833 B1 10/1995
JP 2008-015077 1/2008

* cited by examiner

*Primary Examiner* — Kaitlin Joerger
(74) *Attorney, Agent, or Firm* — Fitzpatrick, Cella, Harper & Scinto

(57) ABSTRACT

The present invention provides a sheet feeding apparatus including a sheet stacking portion, a feeding roller, a biasing member, and a cam member, wherein a predetermined idling section in which the feeding roller does not work with rotation of the feeding shaft is provided between the feeding roller and the feeding shaft, the sheet feeding apparatus comprises a returning mechanism which returns the feeding roller to the initial feeding position after the feeding roller finishes feeding the sheet on the sheet stacking portion, and when a sheet feeding operation is started, at a time when the cam member starts rotating together with the feeding shaft and passes the idling section, the feeding roller starts rotating, feeds out the sheet on the sheet stacking portion and then is returned to the initial feeding position by the returning mechanism.

6 Claims, 11 Drawing Sheets

SHEET FEEDING APPARATUS AND IMAGE FORMING APPARATUS

BACKGROUND OF THE INVENTION

1. Field of the Invention

The present invention relates to a sheet feeding apparatus included in an image forming apparatus, which forms images on sheets, such as a copying machine and a laser beam printer and an image forming apparatus which has the sheet feeding apparatus.

2. Description of the Related Art

Conventionally, a sheet feeding apparatus provided in an image forming apparatus generally feeds the upper most sheet of sheets stacked on a lifting/lowering plate sequentially to an image forming portion by means of a feeding roller. This sheet feeding apparatus is configured to apply a force to a lifting/lowering plate provided to rock, in a feeding roller direction by means of a coil spring, and press the uppermost surface of the sheets stacked on the lifting/lowering plate against the feeding roller.

Further, there is a sheet feeding apparatus which has feeding cams fixed coaxially with a feeding roller, and which is configured such that the feeding cams push a lifting/lowering plate to a certain position, against the biasing force of a coil spring together with the lifting/lowering plate while the feeding roller rotates to feed out sheets (see U.S. Pat. No. 5,253,854).

Thus, the sheet feeding apparatus having a mechanism for pushing the lifting/lowering plate by means of the feeding cams can push the lifting/lowering plate to a certain position upon stand-by. This facilitates a setting and an exchange of sheets, and enhances the separation property of sheets in a separating portion such as a separating pad by pushing the lifting/lowering plate while sheets are sent out.

Further, there is an image forming apparatus on which the above sheet feeding apparatus is mounted (see Japanese Patent Laid-Open No. 2008-015077). An operation of this sheet feeding apparatus from feeding of sheets, forming of images to discharging of the sheets in an image forming apparatus will be schematically described with reference to FIG. 11.

As illustrated in FIG. 11, sheets S set on a sheet tray 1 are sent out when driving of a driving motor 16 is transmitted to rotate a feeding roller 2, and are separated by a separating pad.

The sheets S which are fed are conveyed to a transferring nip including a photosensitive drum 8 and a transfer roller 9 forming an image transferring portion through conveying rollers 3*a* and 3*b*. A lifting/lowering plate 22 provided to the sheet tray 1 can be lifted and lowered and is applied an upward force by a feeding spring 23. Cams 21 are provided coaxially with the feeding roller 2, and are in slidable contact with cam followers 22*b* provided in the lifting/lowering plate 22. Then, when the feeding roller 2 rotates, the cams 21 rotate to lift and lower the lifting/lowering plate 22 through the cam followers 22*b*, and the lifting/lowering plate 22 is lifted to press the sheets S against the feeding roller 2 to convey the sheets S.

By contrast with this, an image writing laser scanner 5 draws an electrostatic latent image on the photosensitive drum 8 in a process cartridge 7 to prepare for toner images. A toner image formed on the photosensitive drum 8 is transferred as a non-fixed image to the sheet S by the transferring nip including the photosensitive drum 8 and the transfer roller 9. In order to heat-fix this non-fixed image, the sheet S is sent to a fixing roller 11 to heat-fix the non-fixed image. The sheet S on which the image is fixed is sent to a discharge roller 12 along a conveying guide 15, and is discharged to a discharge tray 14.

However, with the above conventional example, when a rotating speed of the feeding roller 2 is increased to increase a sheet feeding speed, or when the diameter of the feeding roller 2 is made smaller to miniaturize a sheet feeding apparatus, the speed of rocking movement of the lifting/lowering plate 22 increases. As a result, there are a concern that noise becomes large when sheets abut on the feeding roller 2 and a concern that, when a feeding operation is repeated, an impact produced when sheets abut on the feeding roller 2 misaligns the stacked sheets. When sheets are misaligned, sheets are skewed while being fed and there is an issue of causing, for example, poor image quality and jamming.

The present invention provides a sheet feeding apparatus which suppresses a lifting speed of a lifting/lowering plate by providing an idling section between a feeding roller and feeding cams and stably feeds sheets with little noise upon a high-speed operation, and an image forming apparatus having this sheet feeding apparatus.

SUMMARY OF THE INVENTION

The present invention provides a sheet feeding apparatus including a sheet stacking portion which is lifted and lowered with a sheet stacked thereon, a feeding roller which is attached to a feeding shaft and which rotates from an initial feeding position following rotation of the feeding shaft in one direction and feeds out the sheet on the sheet stacking portion, a biasing member which applies a force to the sheet stacking portion and pressures the stacked sheet against the feeding roller, and a cam member which rotates following rotation of the feeding shaft and lifts and lowers the sheet stacking portion, wherein a predetermined idling section in which the feeding roller does not work with rotation of the feeding shaft is provided between the feeding roller and the feeding shaft, the sheet feeding apparatus comprises a returning mechanism which returns the feeding roller to the initial feeding position after the feeding roller finishes feeding the sheet on the sheet stacking portion, and when a sheet feeding operation is started, at a time when the cam member starts rotating together with the feeding shaft and passes the idling section, the feeding roller starts rotating, feeds out the sheet on the sheet stacking portion and then is returned to the initial feeding position by the returning mechanism.

According to the present invention, it is possible to provide an image forming apparatus which can suppress a lifting speed of a sheet stacking portion more than a conventional configuration by providing an idling section, and which causes less noise by reducing occurrence of noise when sheets on the sheet stacking portion hit the feeding rollers. Further, by suppressing the lifting speed of the sheet stacking portion, it is possible to stably feed the sheets without misaligning the sheets on the sheet stacking portion.

Further features of the present invention will become apparent from the following description of exemplary embodiments with reference to the attached drawings.

DESCRIPTION OF THE EMBODIMENTS

First Embodiment

Figure 4:
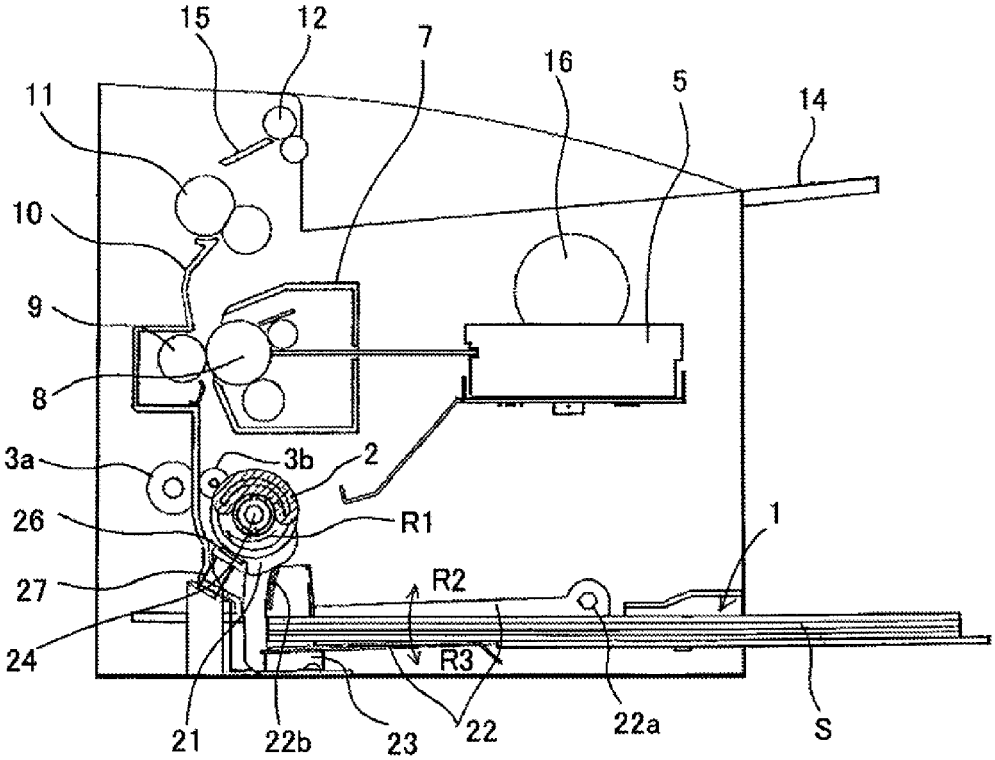
FIG. 4 is a sectional view illustrating a schematic configuration of an image forming apparatus according to the first embodiment.
Figure 11:
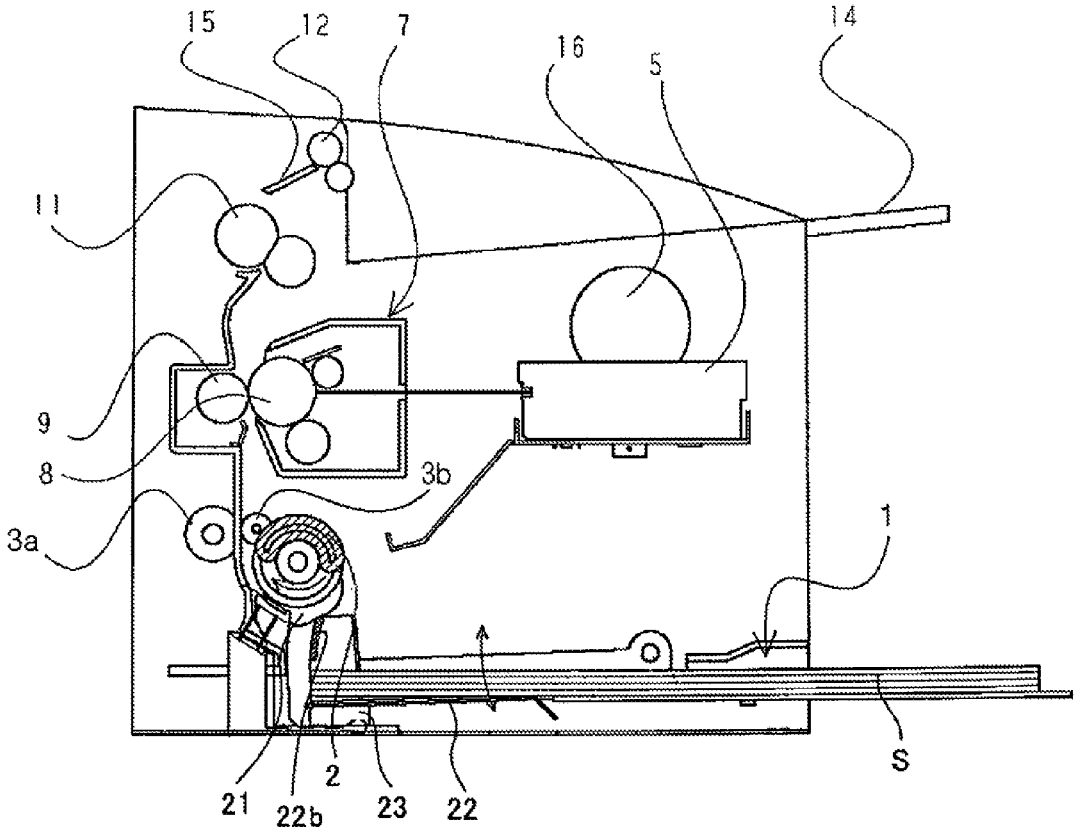
FIG. 11 PRIOR ART
FIG. 11 is a sectional view illustrating a schematic configuration in a conventional image forming apparatus.

The present invention will be described below based on embodiments. FIG. 4 is a sectional view describing a schematic configuration of an image forming apparatus on which a sheet feeding apparatus according to the present invention is mounted. The configuration, image process, and a start of feeding of sheets to discharging of the sheets of the image forming apparatus according to the present embodiment are substantially the same as a conventional example described with reference to FIG. 11. Further, parts having the same functions as the conventional example of FIG. 11 are assigned the same reference numerals.

As illustrated in FIG. 4, a sheet feeding apparatus provided in an image forming apparatus according to the present invention has a sheet tray 1 which has a lifting/lowering plate 22, a feeding roller 2, a feeding spring 23, and feeding cams 21. The lifting/lowering plate 22 forms a sheet stacking portion which can be lifted and lowered with the sheets S stacked thereon. The feeding roller 2 rotates from an initial feeding position (position illustrated in FIGS. 2 and 6A) following rotation of a feeding shaft 24 in one direction, and feeds out the sheets S on the lifting/lowering plate 22 (on the sheet stacking portion). The feeding spring 23 forms a biasing member which pressures the sheets S of the lifting/lowering plate 22 against the feeding roller 2. The feeding cams 21 form a cam member which moves the lifting/lowering plate 22 in conjunction with the feeding spring 23 when sheets are fed by the feeding roller 2 and integrally rotates with the feeding shaft 24 to separate the lifting/lowering plate 22 from the feeding roller 2 against the feeding spring 23 after the sheets are fed by the feeding roller 2.

Figure 3:
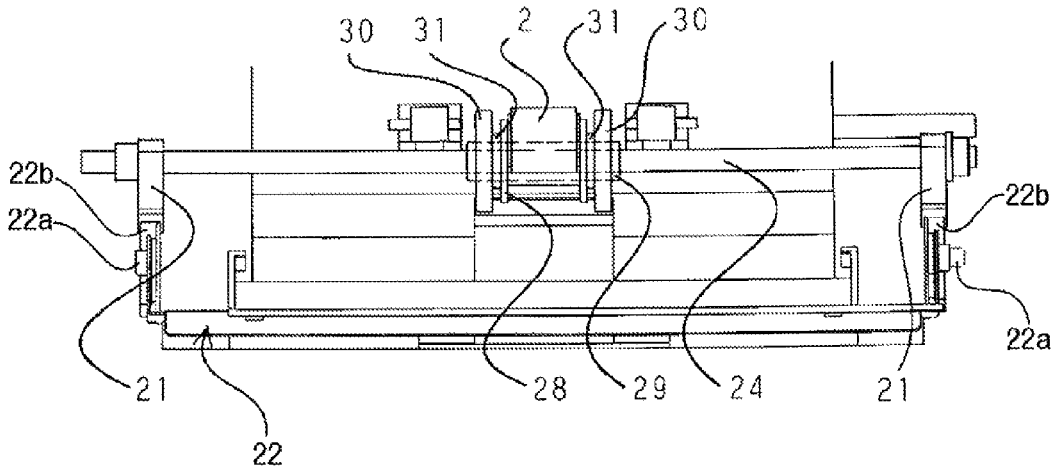
FIG. 3 is a back surface view illustrating a feeding portion in an image forming apparatus according to the first embodiment.

As illustrated in FIG. 3, the feeding cams 21 having the same shape are each fixed to both end portions of the feeding shaft 24 in the same phase. The feeding cams 21 and 21 function as pushing portions which each slide with the cam followers (cam contacting portions) 22*b* and 22*b* respectively provided in both end portions in the front portion of the lifting/lowering plate 22 in the width direction, and push the lifting/lowering plate 22 against the biasing force of the feeding spring 23. The lifting/lowering plate 22 is provided in the sheet tray 1, and is configured to make rocking movement corresponding to one round trip in the arrow R2 and R3 directions per rotation of the feeding cams 21 using the lifting/lowering plate bosses 22*a* as the rotation supporting point.

In FIG. 4, the feeding operation of the sheets S set on the sheet tray 1 starts when the driving motor 16 activates and a feeding roller solenoid in a driving mechanism apparatus which is not illustrated retracts. The sheets S separated and fed by the separating pad 26 following rotation of the feeding roller 2 and sent out from the lifting/lowering plate 22 are conveyed toward the downstream side by the conveying rollers 3*a* and 3*b*, and conveyed to a transferring nip including the photosensitive drum 8 and the transfer roller 9 which form the image transferring portion.

The image writing laser scanner 5 draws an electrostatic latent image on the photosensitive drum 8 in the process cartridge 7, and prepares for toner images. A toner image formed on the photosensitive drum 8 is transferred on the sheet S as a non-fixed image by the transferring nip including the photosensitive drum 8 and the transfer roller 9. In order to heat-fix this non-fixed image, the sheet S is sent to the fixing roller 11 to heat-fix the non-fixed image. The sheet S on which the image is fixed is sent to the discharge roller 12 along the conveying guide 15. The discharge roller 12 and a discharge roller which is applied with an elastic force and abutted form a nip and discharge the sheet S to the discharge tray 14. The above photosensitive drum 8 and the transfer roller 9 form an image forming portion which forms images on the sheets S fed by the sheet feeding apparatus. In addition, 27 denotes a separating pad spring.

Figure 1:
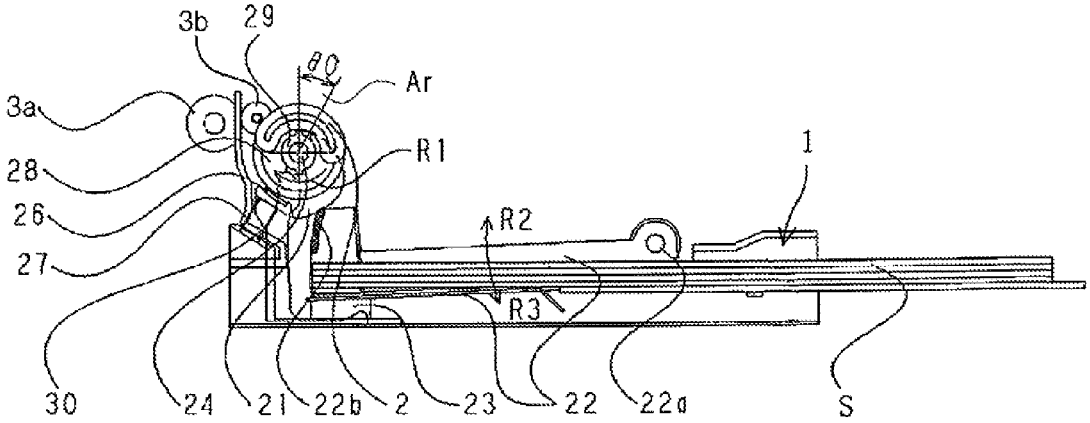
FIG. 1 is a sectional view illustrating a schematic configuration of a feeding portion in an image forming apparatus according to an embodiment of the present invention.

The feeding mechanism of the sheet feeding apparatus according to the present invention will be described with reference to FIGS. 1 to 3. FIG. 1 is an enlarged view of the feeding mechanism portion in FIG. 4, FIG. 2 is an enlarged view near the feeding roller in FIG. 4, and FIG. 3 is an enlarged front view of the feeding mechanism in FIG. 4.

As illustrated in FIG. 1, the sheet tray 1 is arranged as a sheet accommodating portion on which a bundle of the sheets S can be stacked. The feeding spring 23 is provided in a lower surface portion of the lifting/lowering plate 22, and applies a biasing force to the lifting/lowering plate 22 in the arrow R2 direction in FIG. 1. The feeding shaft 24 is attached rotatably to a frame which is not illustrated, and a rotation driving force is transmitted to this feeding shaft 24 from the driving train which is not illustrated.

Figure 2:
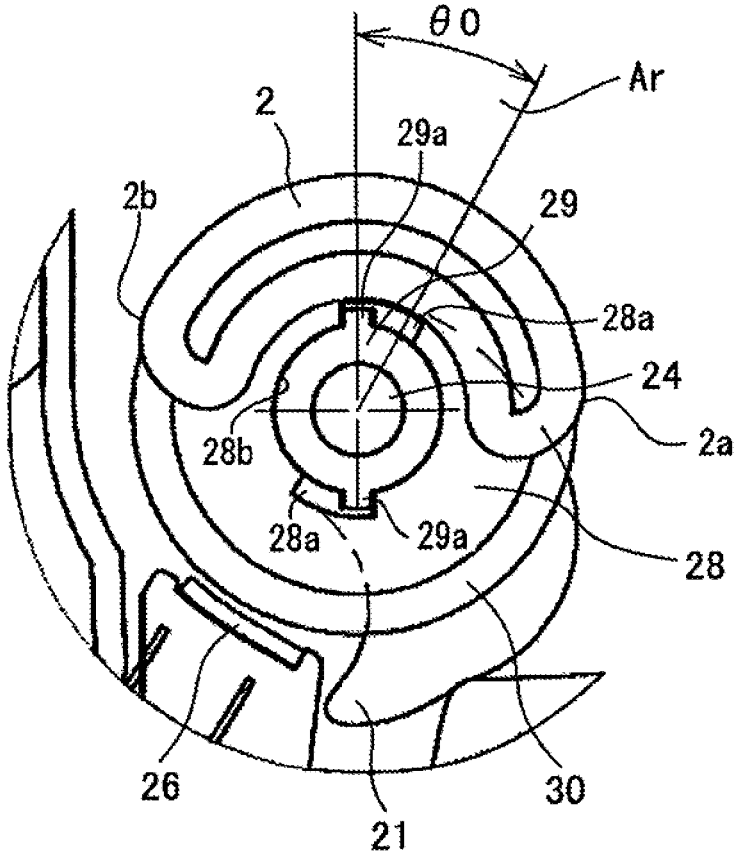
FIG. 2 is a sectional view illustrating main parts of a feeding portion in an image forming apparatus according to the first embodiment.

As illustrated in FIGS. 1 and 2, a serration member 29 is fixed to the feeding shaft 24. As illustrated in FIG. 3, the serration member 29 is formed in a cylindrical shape which has a length corresponding to the length between the feeding rollers 30 and 30 and is fit and fixed to the feeding shaft 24, and convex portions 29*a* and 29*a* extending in the axial direction are formed at positions on a straight line in the outer periphery.

The feeding roller 2 is supported by the feeding shaft 24 through the feeding roller holder 28 in a state where the feeding roller 2 is detachably attachable to the feeding roller holders 28. The feeding roller 2 has a function of feeding out the uppermost sheet of the sheets S, and a rubber member which is a friction portion contacting the sheets S is provided within a certain angle (in the range of a predetermined angle) on the circumference. The feeding roller 2 is configured such that a rubber member is formed in a range of a predetermined angle around the feeding shaft 24, the curvature radius of the rubber member is formed larger than the radius of the feeding rollers 30, and the outer surface projects outward beyond the outer peripheral surface of the feeding rollers 30. The feeding rollers 30 are rotatably supported by the shaft of the feeding roller 2, and press against the separating pad 26 in a state where the rubber member of the feeding roller 2 is not pressed against the separating pad 26.

As illustrated in FIG. 3, the feeding roller holder 28 has concave portions 28*a* and 28*a* which form an idling section Ar of θ0° in the rotating direction and which meet the convex portions 29*a* and 29*a*. The feeding roller holder 28 is formed rotatably in the idling section Ar including the concave portions 28*a* and 28*a* and convex portions 29*a* and 29*a*. Notches are formed in the concave portions 28*a* and 28*a* to rotate and move the convex portions 29*a* and 29*a* with some margin, in the serration member 29 penetrating shaft holes 28*b* formed in the center of the feeding roller holders 28. The idling section Ar is a predetermined section which is provided between the feeding roller 2 and the feeding shaft 24, and in which the feeding roller 2 does not work with rotation of the feeding shaft 24.

Thus, the concave portions 28*a* and 28*a* are provided on the feeding roller holder side, the convex portions 29*a* and 29*a* are provided on the feeding shaft, and the concave portions 28*a* and 28*a* and the convex portions 29*a* and 29*a* form the idling section Ar. In addition, although the concave portions are provided on one feeding roller holder 28 side and the convex portions are provided on the other feeding shaft 24 side, the concave portions and the convex portions formed on one side and the other side may be reversely formed and it naturally follows that the same idling section Ar can be realized in this case.

The feeding roller 2 starts rotating from the initial feeding position illustrated in FIG. 2, makes the rotation downstream side end portion 2*a* abut on the sheets S on the lifting/lowering plate 22, and feeds out these sheets S from the rotation upstream side end portion 2*b*. Then, the feeding roller 2 is returned to the initial feeding position by the feeding rollers 30 which are rotated accompanying the sheets S conveyed toward the downstream side by the conveying rollers 3*a* and 3*b*.

As illustrated in FIG. 3, the feeding roller 2 is provided in the center of the feeding shaft 24, and the feeding rollers 30 and 30 are provided on both sides of the feeding roller 2 in the axial direction. These feeding rollers 30 and 30 are rotatably attached to the serration member 29. Between the feeding roller 2 and each of the feeding rollers 30 on both sides, the feeding roller holders 28 are arranged. Further, between the feeding roller holders 28 and the feeding rollers 30, the serration springs 31 which are compression springs are provided. The serration springs 31 form driving force transmitting members which transmit a certain amount of driving force, between the feeding roller holders 28 and the feeding rollers 30. By this means, the feeding rollers 30 are configured to work with the feeding roller 2 within a predetermined torque in one direction in a state where the feeding rollers 30 are supported by the feeding shaft 24 coaxially with the feeding roller 2. As described above, it is possible to realize a durable and reliable sheet feeding apparatus with a simple and cheap configuration of providing the serration springs 31 between the feeding roller holders 28 and the feeding rollers 30.

In addition, the feeding rollers 30 and the conveying rollers 3*a* and 3*b* form a returning mechanism. This returning mechanism functions to return the feeding roller 2 to the initial feeding position beyond the idling section Ar after finishing feeding the sheets S on the lifting/lowering plate 22 by means of the feeding roller 2. With this sheet feeding apparatus, when the sheet feeding operation starts, the feeding roller 2 starts rotating to feed out the sheets S on the lifting/lowering plate 22 from the time when feeding cams 21 start rotating together with the feeding shaft 24 and pass the idling section Ar. Then, the feeding roller 2 is returned to the initial feeding position by the above returning mechanism.

As illustrated in FIG. 1, the separating pad 26 is a friction member provided at a position facing the feeding rollers 30, and functions to separate the sheets S when the sheets are fed. The separating pad spring 27 of the second biasing member is provided on the back surface of the separating pad 26, and has a function of applying a force to the separating pad 26 against the feeding roller 2 and the feeding rollers 30.

Next, the operation of the feeding mechanism according to the present invention will be sequentially described with reference to FIGS. 6 and 7. Here, to illustrate the rotation positions of the feeding cams 21, the point which is provided above the feeding cams 21 and which contacts the lifting/lowering plate 22 in the initial feeding position is illustrated as P5.

Figure 6A:
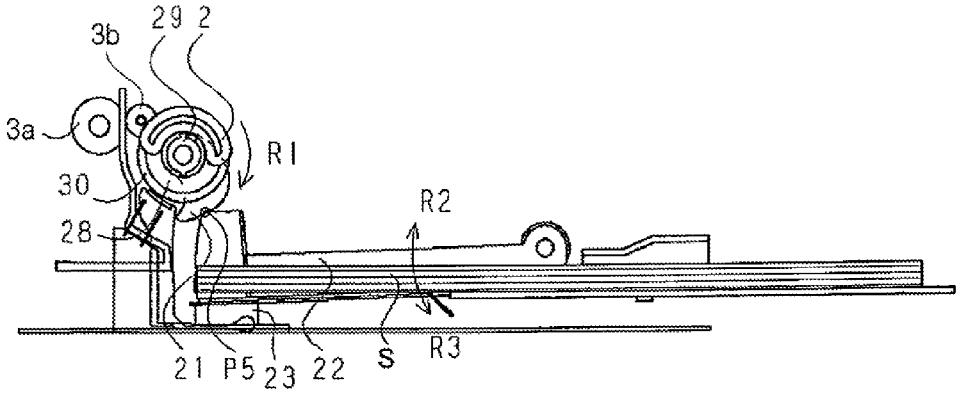
FIGS. 6A, 6B and 6C are views respectively illustrating an operation of a feeding portion in an image forming apparatus according to the first embodiment.

The positions of the feeding roller 2, the feeding roller holders 28, the serration member 29, the feeding cams 21, and the lifting/lowering plate 22 illustrated in FIG. 6A are the initial feeding positions.

First, when a signal is input to a solenoid which is not illustrated, from an electric substrate which is not illustrated and the solenoid is attracted (retracted), a rotation driving force in the arrow R1 direction is transmitted to the feeding shaft 24 from the driving train which is not illustrated. Then, the serration member 29 fixed to the feeding shaft 24 and the feeding cams 21 start rotating. When the feeding cams 21 rotate, the lifting/lowering plate 22 to which a biasing force is applied from the feeding spring 23 starts rotating (being lifted) in the arrow R2 direction.

Figure 6B:
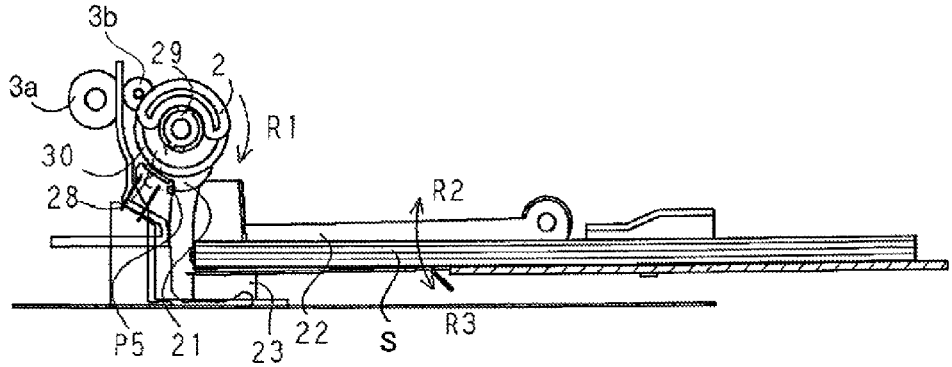

Next, when the feeding shaft 24, the serration member 29, and the feeding cams 21 rotate θ0°, the idling section Ar between the serration member 29 and the feeding roller holder 28 disappear and the feeding roller 2 fixed to the feeding roller holders 28 starts rotating (FIG. 6B).

Figure 6C:
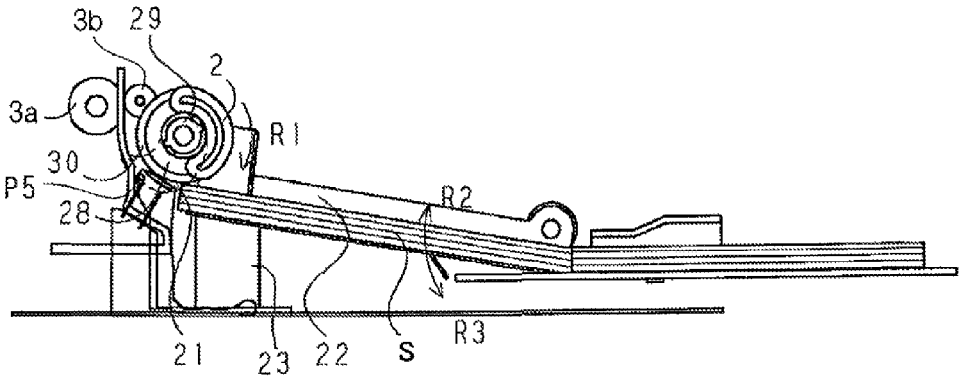

The sheets S are stacked on the lifting/lowering plate 22, and, when the uppermost surface of the sheets S abuts on the feeding rollers 30, the lifting/lowering plate 22 stops. After the lifting/lowering plate 22 stops, a rotation downstream side end portion 2*a* (see FIG. 2) of the friction portion of the feeding roller 2 slidably contacts the uppermost sheet S on the lifting/lowering plate 22 to start feeding the sheets S (FIG. 6C).

Figure 7A:
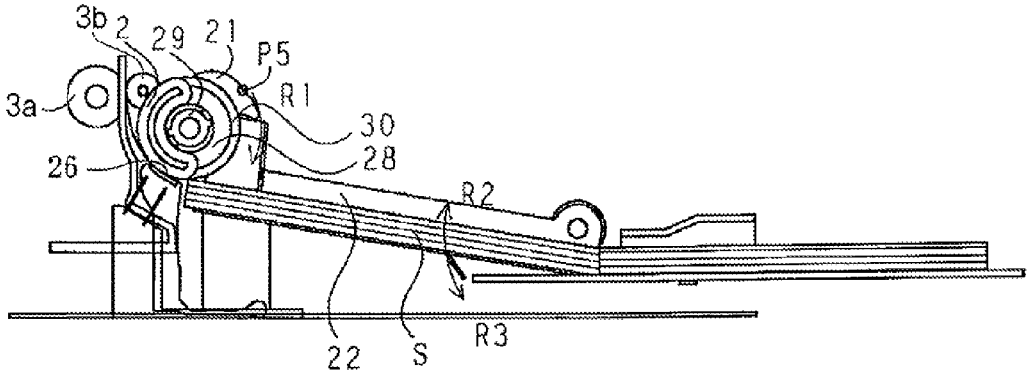
FIGS. 7A and 7B are views respectively illustrating an operation of a feeding portion in an image forming apparatus according to the first embodiment.

After the sheet front end is fed to the nipping position of the conveying rollers 3*a* and 3*b*, the feeding cams 21 start pushing the lifting/lowering plate 22 in the arrow R3 direction (FIG. 7A).

Figure 7B:
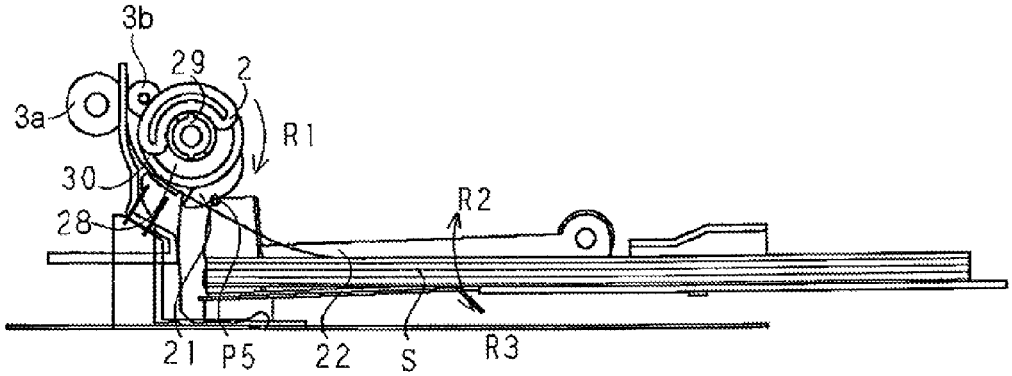

When the lifting/lowering plate 22 returns to the initial feeding position, transmission of the rotation driving force to the feeding shaft 24 is stopped, and the feeding shaft 24, serration member 29, and the feeding cams 21 stop rotating (FIG. 7B). At this time, only the feeding roller 2 is positioned (hereinafter, "adjacent position") immediately before the initial feeding position (the state where the concave portions 28*a* are on the front side of the convex portions 29*a*). In this state, the feeding cams 21 separate the sheets S on the lifting/lowering plate 22 from the feeding rollers 30, so that it is possible to cancel the back tension which works on the sheets S nipped, pulled and conveyed by the conveying rollers 3*a* and 3*b*.

By contrast with this, the conveying rollers 3*a* and 3*b* continue rotating, so that the sheets S fed to the nipping position of the conveying rollers 3*a* and 3*b* are conveyed. Then, the sheets S are nipped by the separating pad 26 and the feeding rollers 30, and the feeding rollers 30 are applied with the driving force from the sheets S which are being conveyed and rotate accompanying the sheets S in the arrow R1 direction. As described above, the feeding rollers 30 transmit a certain amount of driving force to the feeding roller holders 28 by means of the serration springs 31, so that the feeding roller holders 28 and the feeding roller 2 rotate in the arrow R1 direction. Then, when the upstream ends in the concave portions 28*a* abut on the convex portions 29*a* and stop, the feeding roller 2 returns to the initial feeding position (FIG. 6A).

Here, the feeding roller 2 is moved from the adjacent position to the initial feeding position because the feeding roller 2 needs to be retracted from the sheet conveying surface. That is, when the feeding roller 2 is in the adjacent position, there is a possibility that the rotation upstream side end portion 2*b* of the feeding roller 2 comes close to the sheet conveying surface and the feeding roller 2 contacts the sheets S which are being conveyed. When the feeding roller 2 and the conveyed sheets S contact, paper dust is produced from the contacting portion due to friction of the sheets S. When this paper dust is produced, there are issues that the friction force of the feeding roller 2 decreases or various rollers in the downstream of the sheet conveying path become dirty. To prevent this, with the present embodiment, the feeding roller 2 is moved to the initial feeding position from the adjacent position to sufficiently secure the distance between the feeding roller 2 and the sheet conveying surface.

By repeating the above operation, the sheets S stacked on the sheet tray 1 are separated and fed one by one per rotation of the feeding roller 2.

Figure 5:
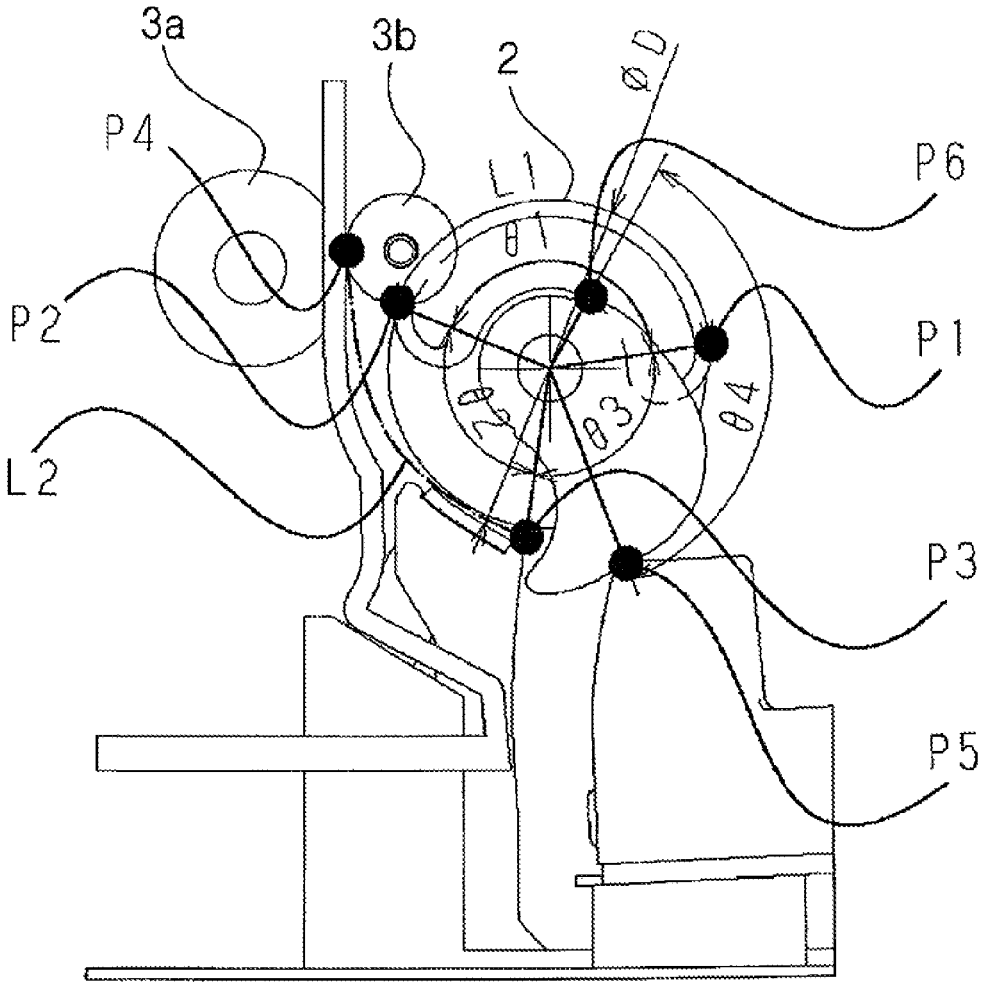
FIG. 5 is a sectional view illustrating main parts of a feeding portion in an image forming apparatus according to the first embodiment.

Next, the design condition of the feeding roller 2 and the feeding cams 21 for realizing the operation of the above feeding mechanism will be described with reference to FIG. 5. FIG. 5 is an enlarged view of the feeding roller 2 and its vicinity in FIG. 4, and illustrates the initial feeding position of this feeding mechanism. For ease of description, the design condition of a conventional example where the idling section Ar (θ0) is not provided will be first described.

First, each symbol used to describe the design condition will be defined. The friction portion start point of the feeding roller 2 is P1, the friction portion end point of the feeding roller 2 is P2, the point where the feeding roller 2 feeds the uppermost sheet S of the stacked sheets S is a feeding point P3, and the nipping position of the conveying rollers 3*a* and 3*b* is P4. Here, the friction portion start point P1 and the friction portion end point P2 move following rotation of the feeding roller 2. Further, the feeding point P3 and the nipping position P4 are fixed points.

The point which is provided on the feeding cams 21 and which contacts the lifting/lowering plate 22 in the initial feeding position is P5, and the point which is provided on the feeding cams 21 and which the lifting/lowering plate 22 contacts when reaching the top dead point is P6. Here, P5 and P6 move following rotation of the feeding cams 21.

The angle between the friction portion start point P1 and the friction portion end point P2 which are friction portions of the feeding roller 2 is θ1 [deg], and the angle between the friction portion end point P2 and the feeding point P3 of the feeding roller 2 is θ2 [deg]. Further, the angle between the feeding point P3 and the friction portion start point P1 of the feeding roller 2 is θ3 [deg], and the angle between P5 and P6 where the lifting/lowering plate 22 reaches the top dead point from the initial feeding position is θ4 [deg].

The diameter of the feeding roller 2 is (φD [mm], the rotating speed of the feeding roller 2 is ω [deg/sec], the length of the friction portion of the feeding roller 2 is L1 [mm] and the sheet conveying distance between the feeding point P3 and the nipping position P4 indicated by the dashed line in FIG. 5 is L2 [mm].

The design condition for realizing the operation of the feeding mechanism will be described using the above symbols.

The feeding roller 2 needs to convey the fed sheets to the nipping position P4. Further, the amount of conveying the fed sheets becomes equal to L1 if slippery between the friction portion of the feeding roller 2 and sheets is not considered. Therefore, the length L1 of the friction portion of the feeding roller 2 needs to be greater than L2. This is represented by the following equation (1):

$$L1>L2 \quad (1).$$

Here, the length L1 of the friction portion of the feeding roller 2 is the following equation (2) based on the geometric relationship:

$$L1=\pi D\times(\theta 1/360) \quad (2).$$

The following equation (3) is obtained by substituting equation (2) in equation (1) and combining the equations for θ1:

$$\theta 1>360\times(L2/\pi D) \quad (3).$$

Next, to stabilize the sheet conveying distance upon feeding, after the lifting/lowering plate 22 rotates in the arrow R2 direction of FIG. 1 and the front end of the sheet stacking surface of the uppermost sheet S reaches the feeding point P3, the friction portion start point P1 of the feeding roller 2 needs to reach the feeding point P3. That is, θ4 needs to be a smaller angle than θ3. This is represented by the following equation (4):

$$\theta 3>\theta 4 \quad (4).$$

Further, θ1, θ2 and θ3 need to be completed in one cycle. This is represented by the following equation (5):

$$\theta 1+\theta 2+\theta 3=360 \quad (5).$$

The following equation (6) is obtained by substituting equation (4) in equation (5) and combining the equations for θ4:

$$\theta 4<360-(\theta 1+\theta 2) \quad (6).$$

Further, the time τ [sec] the lifting/lowering plate 22 takes to move from the initial feeding position to the top dead point position P6 is represented by the following equation (7):

$$\tau=\theta 4/\omega \quad (7).$$

However, with a conventional example, θ4 is not likely to take a sufficiently large value because of the relationship with equation (6). That is, L2 and φD are determined according to the configuration, and the lower limit value of θ1 is determined according to equation (3). Further, θ2 is inevitably determined based on the geometric relationship such that the friction portion end point P2 of the feeding roller 2 retracts a sufficient distance from the sheet conveying path. Then, the upper limit value of θ4 is determined according to equation (6).

By contrast with this, the number of rotations ω of the feeding roller 2 is usually set to a high value as much as possible to improve the throughput of the image forming apparatus. As a result, it is difficult to secure a sufficiently long time for the lifting time τ of the lifting/lowering plate 22 because of the relationship of equation (7), the lifting speed of the lifting/lowering plate 22 increases, and there is an issue that noise caused when the sheets S stacked on the lifting/lowering plate 22 hit the feeding rollers 30 becomes large.

However, with the present embodiment, by providing the idling section Ar (θ0°) between the feeding shaft 24 and the feeding roller 2, it is possible to stop the feeding roller 2 in the initial feeding position for the time when the feeding shaft 24 rotates (idles) in the idling section Ar (θ0°). That is, although the upper limit value of θ4 is determined based on the condition of equation (6) with the conventional example, it is possible to loosen the design condition of θ4 as in the following equation (8) by using the configuration according to the present embodiment:

$$\theta 4<(360+\theta 0)-(\theta 1+\theta 2) \quad (8).$$

Further, the stop time of the feeding roller 2 is τ0 [sec] and the following equation (9) is provided:

$$\tau 0=\theta 0/\omega \quad (9).$$

When the diameter ϕD of the feeding roller 2 and the rotating speed ω of the feeding roller 2 are made constant values, the time the lifting/lowering plate 22 takes to be lifted from the initial feeding position to the feeding position can be extended by τ0 [sec] compared to the conventional example.

Figure 8:
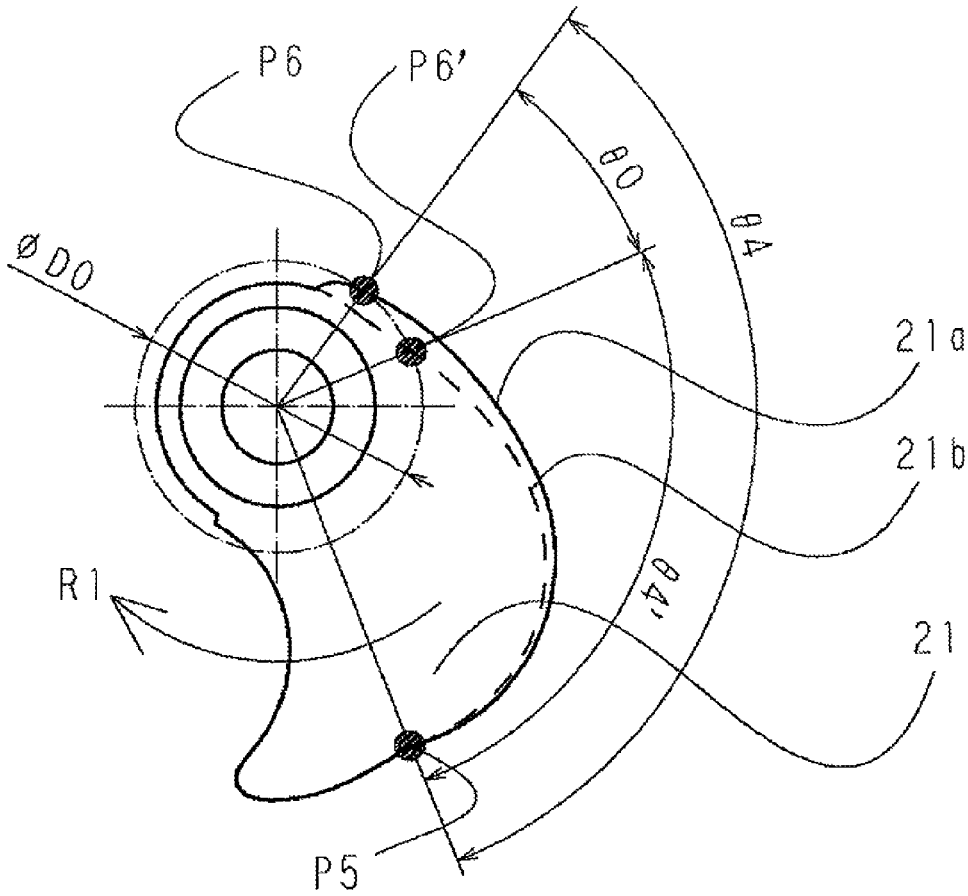
FIG. 8 is a view illustrating main parts of a feeding portion in an image forming apparatus according to the first embodiment.

The design condition of the above equation (8) is loosened, so that, with the present embodiment, by changing the cam curved surfaces of the feeding cams 21 as in FIG. 8, the lifting time of the lifting/lowering plate 22 is configured to be extended by τ0.

Here, ϕD0 is a diameter which does not include a contact point with the lifting/lowering plate 22 when the cam curves of the feeding cams 21 are within ϕD0. That is, when the feeding cams 21 rotate in the arrow R1 direction, the intersection between ϕD0 and the cam curve is the top dead point of the lifting/lowering plate 22. The cam curve 21*b* (broken line) represents a conventional cam curve. Further, the cam curve 21*a* (solid line) represents the cam curve according to the present embodiment.

Here, the intersections between the cam curve 21*b* (conventional example), the cam curve 21*a* (present embodiment) and ϕD0 are each P6' (conventional example) and P6 (present embodiment).

With the conventional example, between P5 and P6', that is, within the range of the angle θ4', the lifting/lowering plate 22 is lifted. By contrast with this, with the present embodiment, the idling section Ar (θ0°) between the feeding shaft 24 and the feeding roller 2, it is possible to move P6' to P6 and lift the lifting/lowering plate 22 within the range of the angle θ4. Consequently, it is possible to extend the lifting time of the lifting/lowering plate 22 as described above.

As described above, according to the present embodiment, when the sheet feeding operation is started, the feeding roller 2 starts rotating and feeds out the sheets S on the lifting/lowering plate 22 at the time when the feeding cams 21 start rotating and pass the idling section Ar. Then, the feeding roller 2 is returned to the initial feeding position by the returning mechanism including the feeding rollers 30 and the conveying rollers 3*a* and 3*b*. Consequently, it is possible to change the cam curves of the feeding cams 21 from the cam curve 21*b* (conventional example) in FIG. 8 to the cam curve 21*a* (present embodiment). Hence, it is possible to move P6' in FIG. 8 to P6, lift the lifting/lowering plate 22 within the range of the angle θ4 instead of the angle θ4' and extend the lifting time of the lifting/lowering plate 22 more than the conventional example.

According to the present embodiment, by changing the cam curve in this way, it is possible to provide an image forming apparatus which suppresses the lifting speed of the lifting/lowering plate 22 more than a conventional configuration, and which causes less noise by reducing occurrence of noise when the sheets S on the lifting/lowering plate 22 hit the feeding rollers 30. Further, by suppressing the lifting speed of the lifting/lowering plate 22, it is possible to stably feed the sheets S without misaligning the sheets S stacked on the lifting/lowering plate 22. As a result, it is possible to provide a more reliable image forming apparatus which can prevent poor image quality and jamming due to skewing of the sheets.

<First Modification> Although, for example, the diameter ϕD of the feeding roller 2 is a fixed value with the first embodiment, the present invention is also suitable when ϕD is made smaller.

That is, with the conventional example, when ϕD is made smaller, θ1 becomes greater according to the relationship of equation (3). Then, θ4 takes a small value according to the relationship of equation (6). As a result, the lifting time τ of the lifting/lowering plate 22 takes a small value according to equation (7), and the lifting speed of the lifting/lowering plate 22 increases, thereby causing noise. However, by employing the configuration described in the first embodiment, it is possible to provide a small image forming apparatus of reduced noise which can also extend the lifting time of the lifting/lowering plate 22 by τ0 [sec].

<Second Modification> Further, although the rotating speed ω [deg/sec] of the feeding roller 2 is a fixed value with the first embodiment, the present invention is also effective when the rotating speed of the feeding roller 2 is made higher.

That is, with the conventional example, when ω increases, the lifting time τ of the lifting/lowering plate 22 takes a small value according to equation (7), and the lifting speed of the lifting/lowering plate 22 increases, thereby increasing noise. However, by using the configuration described in the first embodiment, it is possible to provide a high speed image forming apparatus of reduced noise which can also extend the lifting time of the lifting/lowering plate 22 by τ0 [sec].

Second Embodiment

Figure 9:
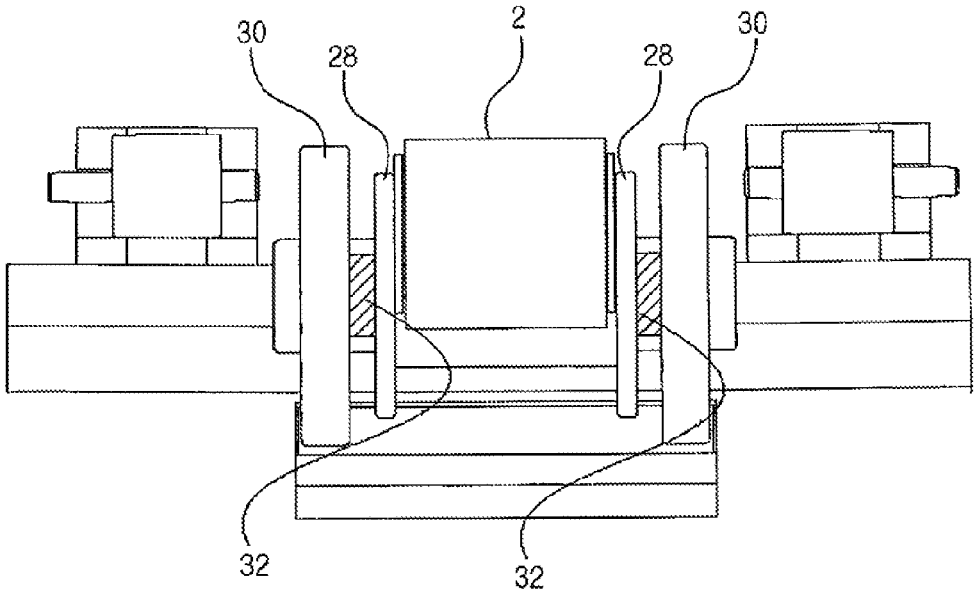
FIG. 9 is a view illustrating main parts of a feeding portion in an image forming apparatus according to a second embodiment.

Further, according to the first embodiment and the first and second modifications, the serration springs 31 which are compression springs are used as members having a function of transmitting a certain amount of driving force, between the feeding roller holder 28 and the feeding rollers 30. Instead of this, as illustrated by the shaded portions in FIG. 9, it is also preferable to employ a configuration of providing the friction members 32 made of a rubber material. Thus, according to a simple and cheap configuration of providing the friction members 32 between the feeding roller holders 28 and the feeding rollers 30, it is possible to realize a durable and reliable sheet feeding apparatus.

Figure 10:
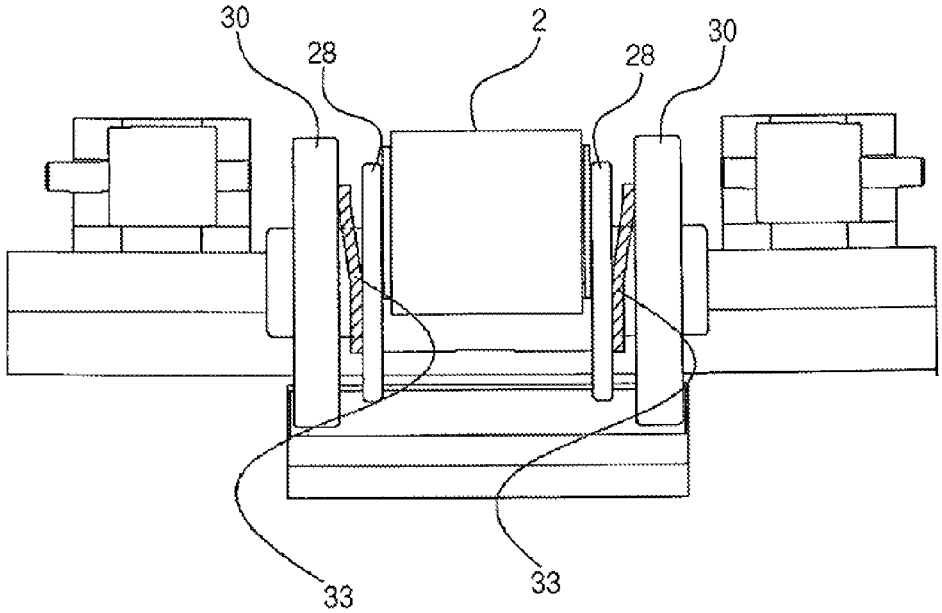
FIG. 10 is a view illustrating main parts of a feeding portion in an image forming apparatus according to the second embodiment.

Further, as illustrated in the shaded portions in FIG. 10, it is also preferable to employ a configuration of providing the leaf springs 33 instead of the serration springs 31. Further, with the first embodiment and the first and second modifications, although the feeding rollers 30 are provided on both sides of the feeding roller 2 in the axial direction, the present invention is by no means limited to this and a configuration of providing the feeding roller 30 on one side is also preferable.

Although exemplary embodiments of the present invention have been described as examples, the scope of the present invention is not limited to the configurations of the above embodiments, and includes various modifications which can be derived within the scope of the technical idea disclosed in the scope of the claims.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-146195, filed Jun. 28, 2010, which is hereby incorporated by reference herein in its entirety.

What is claimed is:

1. A sheet feeding apparatus comprising:

a sheet stacking portion which is lifted and lowered with a sheet stacked thereon;

a feeding roller which rotates from an initial feeding position following rotation of the feeding shaft in one direction and feeds out the sheet on the sheet stacking portion;

a biasing member which applies a force to the sheet stacking portion and pressures the stacked sheet against the feeding roller;

a cam member which rotates following rotation of the feeding shaft and lifts and lowers the sheet stacking portion;

a predetermined idling section, provided between the feeding roller and the feeding shaft, in which the feeding roller does not work with rotation of the feeding shaft at a predetermined angle; and a returning mechanism which returns the feeding roller to the initial feeding position after the feeding roller finishes feeding the sheet on the sheet stacking portion, wherein when the feeding shaft starts rotating together with the cam member and passes the idling section, the feeding roller starts rotating from initial feeding position, feeds out the sheet on the sheet stacking portion and then is returned to the initial feeding position by the returning mechanism.

2. The sheet feeding apparatus according to claim 1, wherein the feeding roller is supported by the feeding shaft through a feeding roller holder, the idling section includes a concave portion is provided on one of the feeding roller holder side and the feeding shaft side and a convex portion is provided on the other side.

3. The sheet feeding apparatus according to claim 1, wherein the returning mechanism includes:

an another feeding roller which is supported by the feeding shaft coaxially with the feeding roller and can work with the feeding roller within a predetermined torque in the one direction;

a conveying roller which conveys the sheet sent out from the sheet stacking portion toward a downstream side; and the feeding roller has a friction portion for feeding the sheet formed within a range of a predetermined angle around the feeding shaft, starts rotating from the initial feeding position, and feeds out the sheet by the friction portion, and is returned to the initial feeding position by the another feeding roller which is rotated accompanying the sheet conveyed in a downstream direction by the conveying roller.

4. An image forming apparatus comprising:

a sheet feeding apparatus which includes:

a sheet stacking portion which is lifted and lowered with a sheet stacked thereon;

a feeding roller which rotates from an initial feeding position following rotation of the feeding shaft in one direction and feeds out the sheet on the sheet stacking portion;

a biasing member which applies a force to the sheet stacking portion, and pressures the stacked sheet against the feeding roller;

a cam member which rotates following rotation of the feeding shaft and lifts and lowers the sheet stacking portion;

a predetermined idling section, provided between the feeding roller and the feeding shaft, in which the feeding roller does not work with rotation of the feeding shaft at a predetermined angle; and a returning mechanism which returns the feeding roller to the initial feeding position after the feeding roller finishes feeding the sheet on the sheet stacking portion, wherein when the feeding shaft starts rotating together with the cam member and passes the idling section, the feeding roller starts rotating from an initial feeding position, feeds out the sheet on the sheet stacking portion and then is returned to the initial feeding position by the returning mechanism; and an image forming portion which forms an image on the sheet fed by the sheet feeding apparatus.

5. The image forming apparatus according to claim 4, wherein the feeding roller is supported by the feeding shaft through a feeding roller holder, and the idling section includes a concave portion is provided on one of the feeding roller holder side and the feeding shaft side and a convex portion is provided on the other side.

6. The image forming apparatus according to claim 5, wherein the returning mechanism includes:

an another feeding roller which is supported by the feeding shaft coaxially with the feeding roller and can work with the feeding roller within a predetermined torque in the one direction; and a conveying roller which conveys the sheet sent out from the sheet stacking portion toward a downstream side, wherein the feeding roller has a friction portion for feeding the sheet formed within a range of a predetermined angle around the feeding shaft, starts rotating from the initial feeding position, and feeds out the sheet by the friction portion, and is returned to the initial feeding position by the another feeding roller which is rotated accompanying the sheet conveyed in a downstream direction by the conveying roller.

* * * * *